US008659500B2

(12) United States Patent
Wu

(10) Patent No.: US 8,659,500 B2
(45) Date of Patent: Feb. 25, 2014

(54) MULTI-ANTENNA FOR A MULTI-INPUT MULTI-OUTPUT WIRELESS COMMUNICATION SYSTEM

(75) Inventor: Min-Chung Wu, Taoyuan County (TW)

(73) Assignee: Ralink Technology Corp., Jhubei, Hsinchu County (TW)

( * ) Notice: Subject to any disclaimer, the term of this patent is extended or adjusted under 35 U.S.C. 154(b) by 443 days.

(21) Appl. No.: 12/632,820

(22) Filed: Dec. 8, 2009

(65) Prior Publication Data

US 2010/0315313 A1 Dec. 16, 2010

(30) Foreign Application Priority Data

Jun. 11, 2009 (TW) ..... 98119522 A

(51) Int. Cl.
*H01Q 21/00* (2006.01)

(52) U.S. Cl.
USPC ..... 343/893; 343/700 MS; 343/793; 343/725; 343/727; 343/729; 343/730

(58) Field of Classification Search
USPC ..... 343/893, 700 MS, 702, 793, 725, 727, 343/729, 730
See application file for complete search history.

(56) References Cited

U.S. PATENT DOCUMENTS

| | | | | |
|---|---|---|---|---|
| 6,426,723 | B1 * | 7/2002 | Smith et al. | 343/700 MS |
| 6,624,790 | B1 * | 9/2003 | Wong et al. | 343/702 |
| 7,408,511 | B2 * | 8/2008 | Liu | 343/700 MS |
| 7,872,608 | B2 * | 1/2011 | Li et al. | 343/702 |
| 7,884,774 | B2 * | 2/2011 | Huang et al. | 343/795 |
| 7,956,811 | B2 * | 6/2011 | Huang | 343/700 MS |
| 2006/0152413 | A1 * | 7/2006 | Uno et al. | 343/700 MS |
| 2007/0229364 | A1 * | 10/2007 | Shor | 343/700 MS |
| 2008/0074326 | A1 * | 3/2008 | Huang et al. | 343/700 MS |
| 2008/0074340 | A1 | 3/2008 | Song | |

FOREIGN PATENT DOCUMENTS

| | | | |
|---|---|---|---|
| EP | 1 115 176 | A2 | 7/2001 |
| WO | WO 2008148404 | A1 * | 12/2008 |

* cited by examiner

*Primary Examiner* — Dieu H Duong
(74) *Attorney, Agent, or Firm* — Winston Hsu; Scott Margo

(57) ABSTRACT

A multi-antenna for a multi-input multi-output wireless communication system includes a substrate, a first planar antenna formed on the substrate along a first direction, a second planar antenna formed on the substrate along a second direction, and a vertical antenna including a conductor formed on the substrate and between the first planar antenna and the second planar antenna, and a radiator perpendicular to the substrate and coupled to the conductor.

20 Claims, 7 Drawing Sheets

MULTI-ANTENNA FOR A MULTI-INPUT MULTI-OUTPUT WIRELESS COMMUNICATION SYSTEM

BACKGROUND OF THE INVENTION

1. Field of the Invention

The present invention relates to a multi-antenna for a multi-input multi-output wireless communication system, and more particularly, to a multi-antenna for realizing three-dimensional polarization diversity and enhancing isolation.

2. Description of the Prior Art

An electronic product with a wireless communication function, such as a laptop computer, a personal digital assistant and so on, usually transmits or receives radio signals through an antenna for transmitting or exchanging radio signals, so as to access a wireless network. Therefore, in order to realize convenient wireless network access, an ideal antenna should have a wide bandwidth and a small size to meet the main stream of reducing a size of the electronic product. In addition, with the advancement of wireless communication technology, the number of antennas placed on the electronic product is increased. For example, a Multi-input Multi-output (MIMO) communication technology is supported by IEEE 802.11n. That is, an electronic product simultaneously transmits and receives radio signals through usage of multiple antennas, and significantly increases data throughput and link range without additional bandwidth or transmission power, to enhance bandwidth efficiency, transmission rate as well as the performance of wireless communication systems.

However, for MIMO applications, the prior art dose not clearly specify corresponding arrangement of the multi-antenna, so the advantages of MIMO is unable to be performed completely.

SUMMARY OF THE INVENTION

Therefore, the present invention provides a multi-antenna for a multi-input multi-output wireless communication system.

The present invention discloses a multi-antenna for a multi-input multi-output wireless communication system, which comprises a substrate, a first planar antenna formed on the substrate along a first direction, a second planar antenna formed on the substrate along a second direction, and a vertical antenna. The vertical antenna includes a conductor formed on the substrate and between the first planar antenna and the second planar antenna, and a radiator perpendicular to the substrate and coupled to the conductor.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
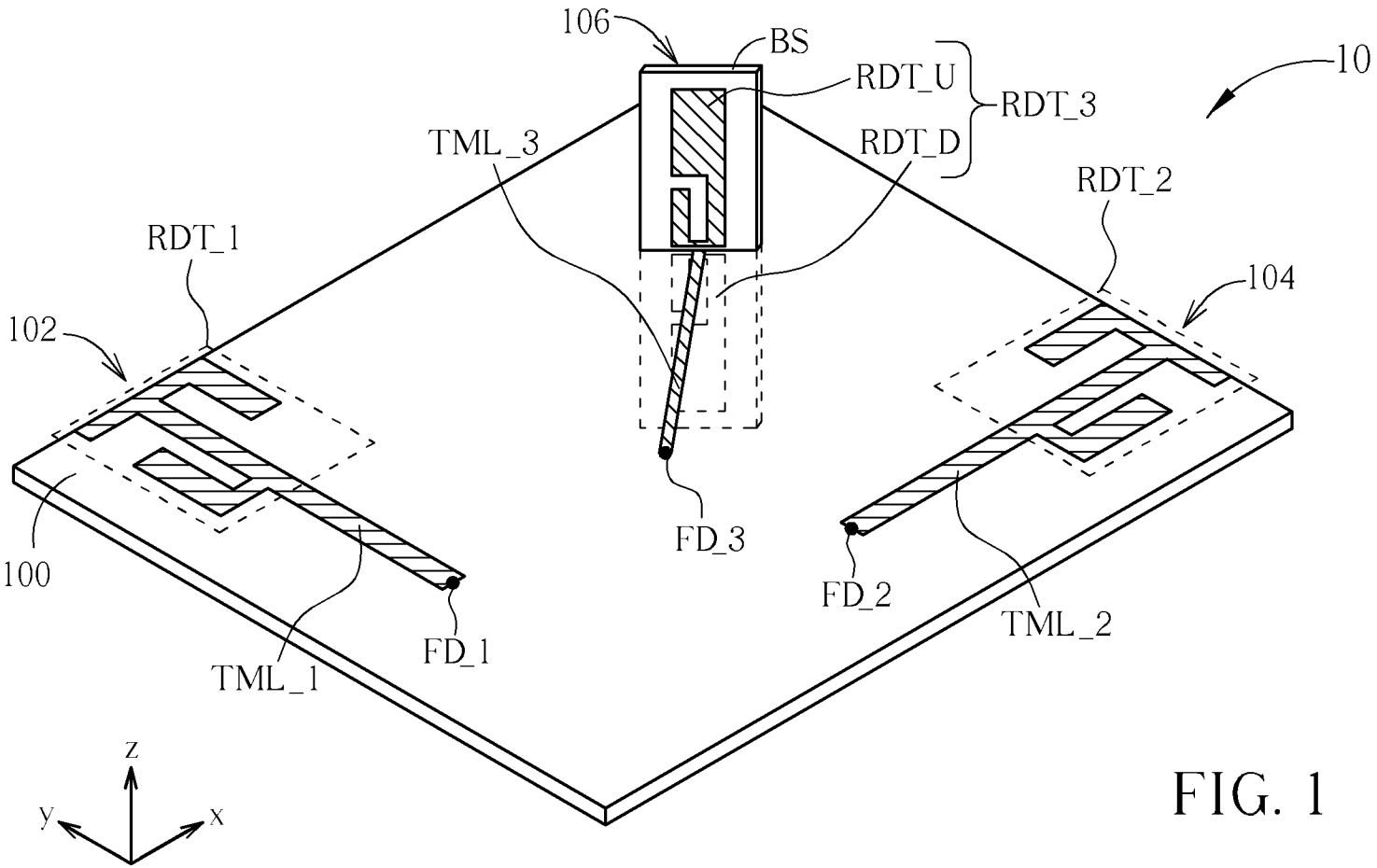
FIG. 1 is a schematic diagram of a multi-antenna according to an embodiment of the present invention.

Please refer to FIG. 1, which is a schematic diagram of a multi-antenna 10 according to an embodiment of the present invention. The multi-antenna 10 may be utilized in a multi-input multi-output (MIMO) wireless communication system conformed to IEEE 802.11n standard, for performing radio signal transmission and reception. The multi-antenna 10 includes a substrate 100, planar antennas 102 and 104, and a vertical antenna 106. The planar antennas 102 and 104 are formed on the substrate 100 by etching or printing, for realizing monopole antennas. In detail, the planar antenna 102 is composed of a radiator RDT_1, a conductor TML_1, and a signal feeding terminal FD_1. Meanwhile, the radiator RDT_1 includes two branches to form a dual band radiating field pattern. In other words, the planar antenna 102 is a dual band monopole antenna. Similarly, the planar antenna 104 is composed of a radiator RDT_2, a conductor TML_2, and a signal feeding terminal FD_2. The shapes of the radiator RDT_2 and the radiator RDT_1 are symmetric. In addition, the vertical antenna 106 is composed of a radiator RDT_3, a conductor TML_3, and a signal feeding terminal FD_3. The radiator RDT_3 includes an upper radiator RDT_U and a lower radiator RDT_D, and is placed on a substrate BS and perpendicular to the substrate 100. The upper radiator RDT_U and the lower radiator RDT_D are symmetric, and are respectively placed above and under the substrate 100, for forming a dipole radiating field pattern. In addition, both of the upper radiator RDT_U and the lower radiator RDT_D include two branches for providing dual band radiating field pattern. In other words, the vertical antenna 106 is a dual band dipole antenna. As can be seen from above, the multi-antenna 10 includes three antennas, and can be utilized in 3T3R (three transmitters and three receivers) system.

Moreover, since the planar antennas 102 and 104 are monopole antennas, and the vertical antenna 106 is a dipole antenna, a time-varying current direction of the planar antenna 102 is along the direction y shown in FIG. 1, a time-varying current direction of the planar antenna 104 is along the direction x, and a time-varying current direction of the vertical antenna 106 is along the direction z. Note that, there is no time-varying current on the x-y plane. In other words, the radiating fields generated by the time-varying currents of the planar antennas 102 and 104 are in 90 degrees of polarization diversity, so there's high isolation between the planar antennas 102 and 104. In addition, since the planar antennas 102 and 104 are in the same plane with common ground, this may cause interference to each other. The present invention places the vertical antenna 106 between the planar antenna 102 and the planar antenna 104, for enhancing the isolation, because the time-varying current direction of the vertical antenna 106 is orthogonal to the time-varying current directions of the planar antennas 102 and 104. In a word, in the multi-antenna 10, the time-varying current directions of the planar antennas 102 and 104, and the vertical antenna 106 are orthogonal to each other; as a result, three-dimensional polarization diversity can be achieved. Meanwhile, since the vertical antenna 106 is placed between the planar antennas 102 and 104, isolation is enhanced and thus improving the efficiency of the multi-antenna 10.

The multi-antenna 10 is an embodiment of the present invention, which generates time-varying currents and linear polarized fields in three orthogonal directions x, y, and z, so as to realize polarization diversity. To realize polarization diversity, the present invention utilizes the monopole planar antennas 102 and 104, and the dipole vertical antenna 106 to generate three orthogonal time-varying current directions. Since the vertical antenna 106 is placed between the planar antenna 102 and the planar antenna 104, the multi-antenna 10 can not only form three-dimensional polarization diversity, but also enhance isolation, so as to increase the antenna efficiency. Note that, those skilled in the art can adjust or modify characteristics of each radiator, such as shape, size, number of branches, material, etc., according to system requirements, and are not limited to the embodiment shown in FIG. 1. Also, design principles related to the characteristics are well-known for those skilled in the art, so the detailed description is omitted herein. For example, if the multi-antenna 10 is applied in a triple-band communication system, each radiator should include three branches. On the other hand, in FIG. 1, the vertical antenna 106 is placed around the center of the planar antenna 102 and the planar antenna 104 for enhancing isolation; however, different positions or designs of the vertical antenna 106 shall belong to the scope of the present invention. For example, the position of the vertical antenna 106 can be closed to the antenna 102 or 104. In addition, the radiator RDT_3 can be rotated, or be implemented by an iron piece to replace the substrate BS.

Figure 2A:
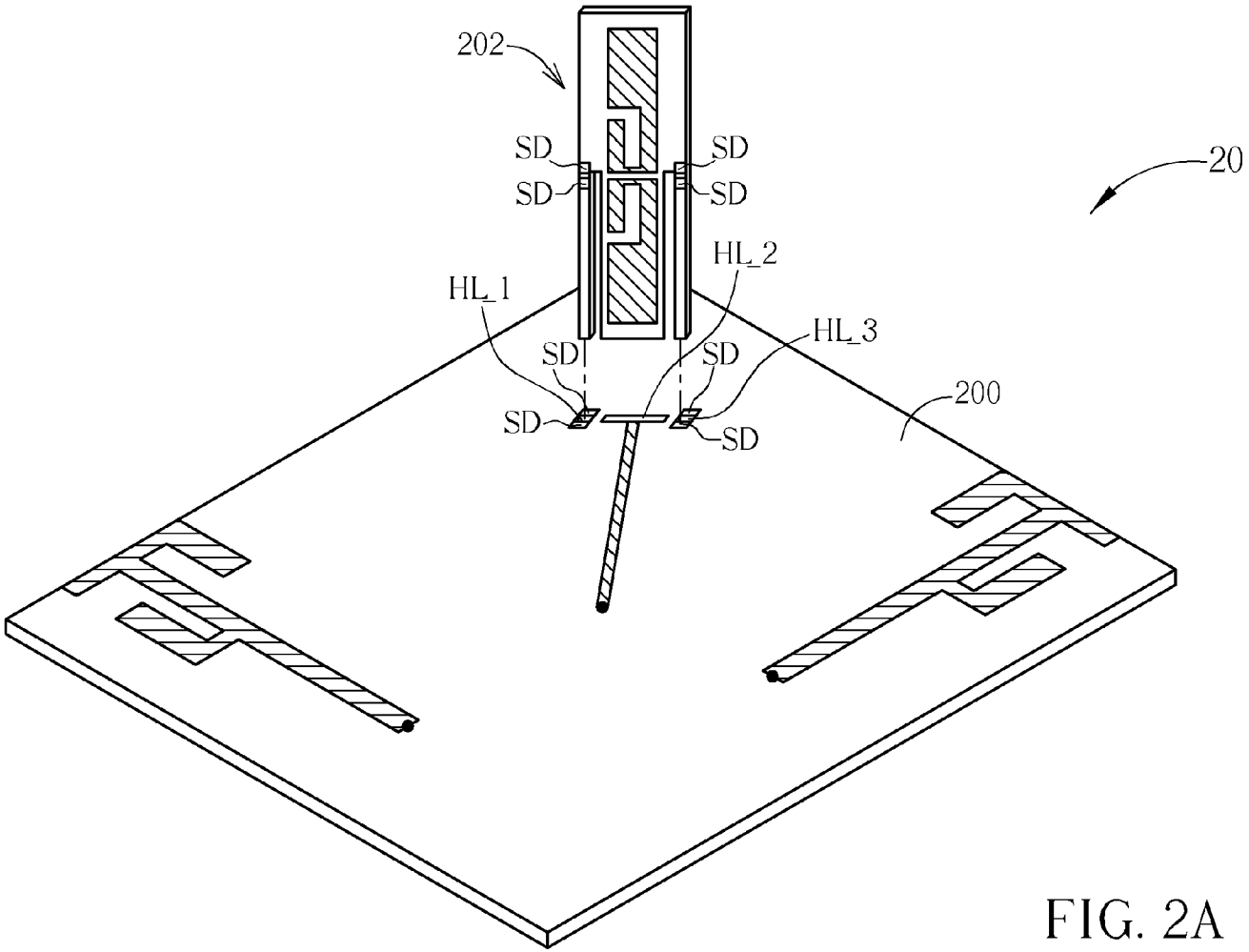
FIG. 2A is an assembly schematic diagram of a multi-antenna.
Figure 2B:
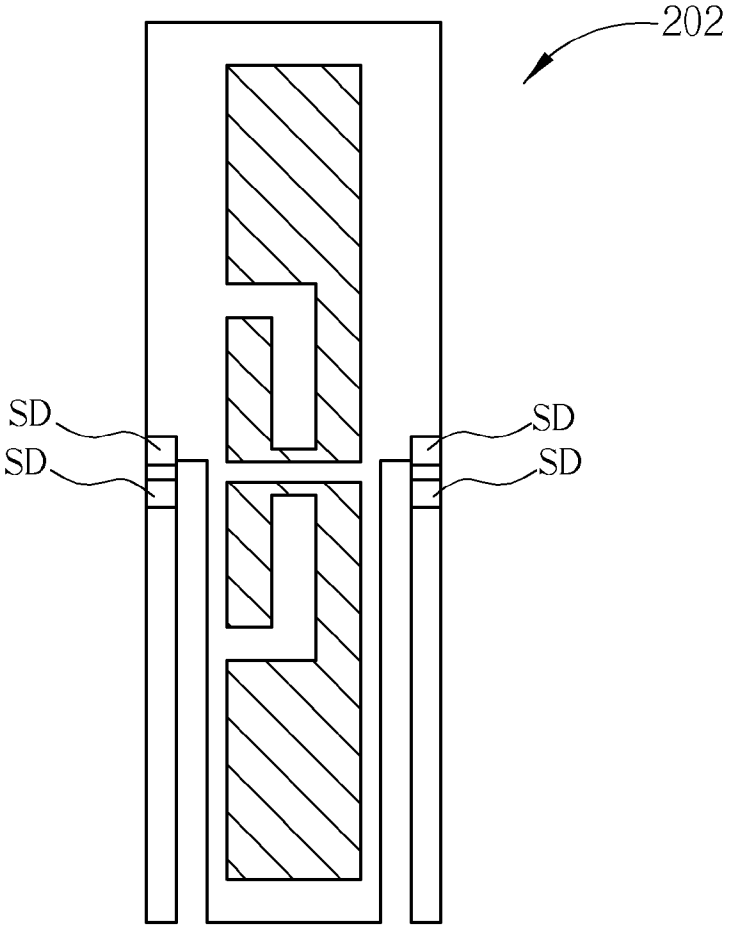
FIGS. 2B-2C are component schematic diagrams of FIG. 2A.
Figure 2C:
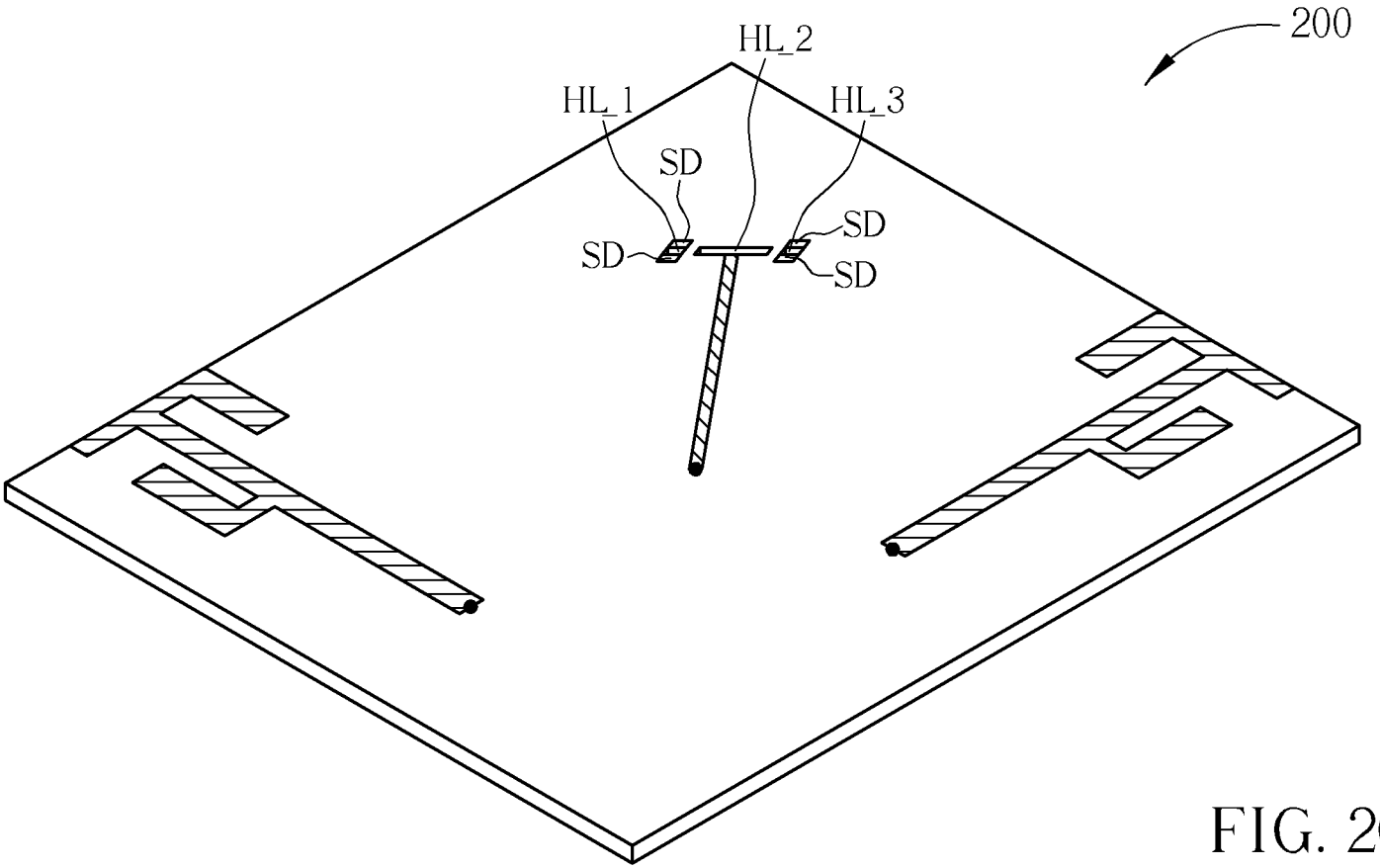

Besides, the manufacturing method of the multi-antenna 10 is not limited to particular rules or steps, as long as the abovementioned purpose can be realized. For example, please refer to FIGS. 2A-2C. FIG. 2A is an assembly schematic diagram of a multi-antenna 20, and FIGS. 2B and 2C are component schematic diagrams of the multi-antenna 20. The multi-antenna 20 shown in FIGS. 2A-2C is utilized for illustrating an exemplary manufacturing method of the present invention. For simplicity, a structure, components, and operation method of the multi-antenna 20 are similar to those of the multi-antenna 10, and labels of the most components are omitted. As can be seen in FIGS. 2A-2C, the multi-antenna 20 is composed of two parts, a plane part 200 and a vertical part 202. In FIGS. 2B and 2C, the vertical part 202 is in a three-plug design for being inserted into holes HL_1, HL_2, and HL_3 of the plane part 200, and is fixed on the plane part 200 through different solder points SD. Components of the plane part 200 and the vertical part 202 can be referred to the multi-antenna 10 of FIG. 1, so the details are omitted herein.

The manufacturing method shown in FIGS. 2A-2C is only an embodiment of the present invention, and is not limited herein.

For 3T3R application, the prior art does not disclose the corresponding arrangement method of the multi-antenna, so the advantages of the multi-antenna cannot be completely performed. In comparison, in the multi-antenna 10 of the present invention, the time-varying current directions of the planar antennas 102 and 104, and the vertical antenna 106 are orthogonal to each other, to form three-dimensional polarization diversity. Meanwhile, since the vertical antenna 106 is placed between the planar antenna 102 and the planar antenna 104, isolation can be enhanced for increasing antenna efficiency. Note that, the abovementioned radiating characteristics of the multi-antenna 10, such as measurement and simulation of time-varying current direction, gain pattern, isolation, etc., are well-known for those skilled in the art, so related descriptions are omitted because they are not main points of the present invention. Detailed description about isolation can be referred as follows.

Figure 3A:
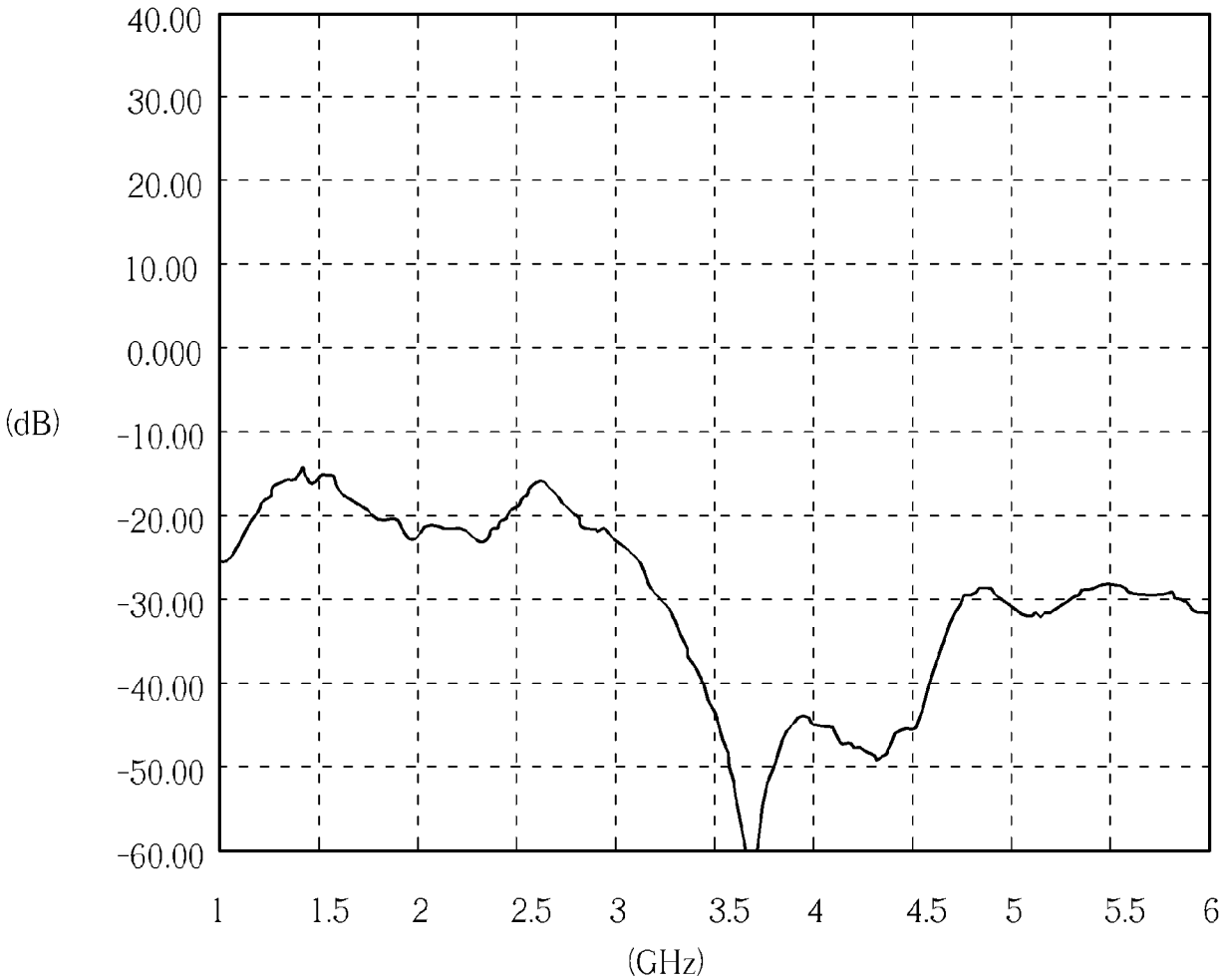
FIGS. 3A-3C are return loss diagrams of the multi-antenna of FIG. 1.
Figure 3B:
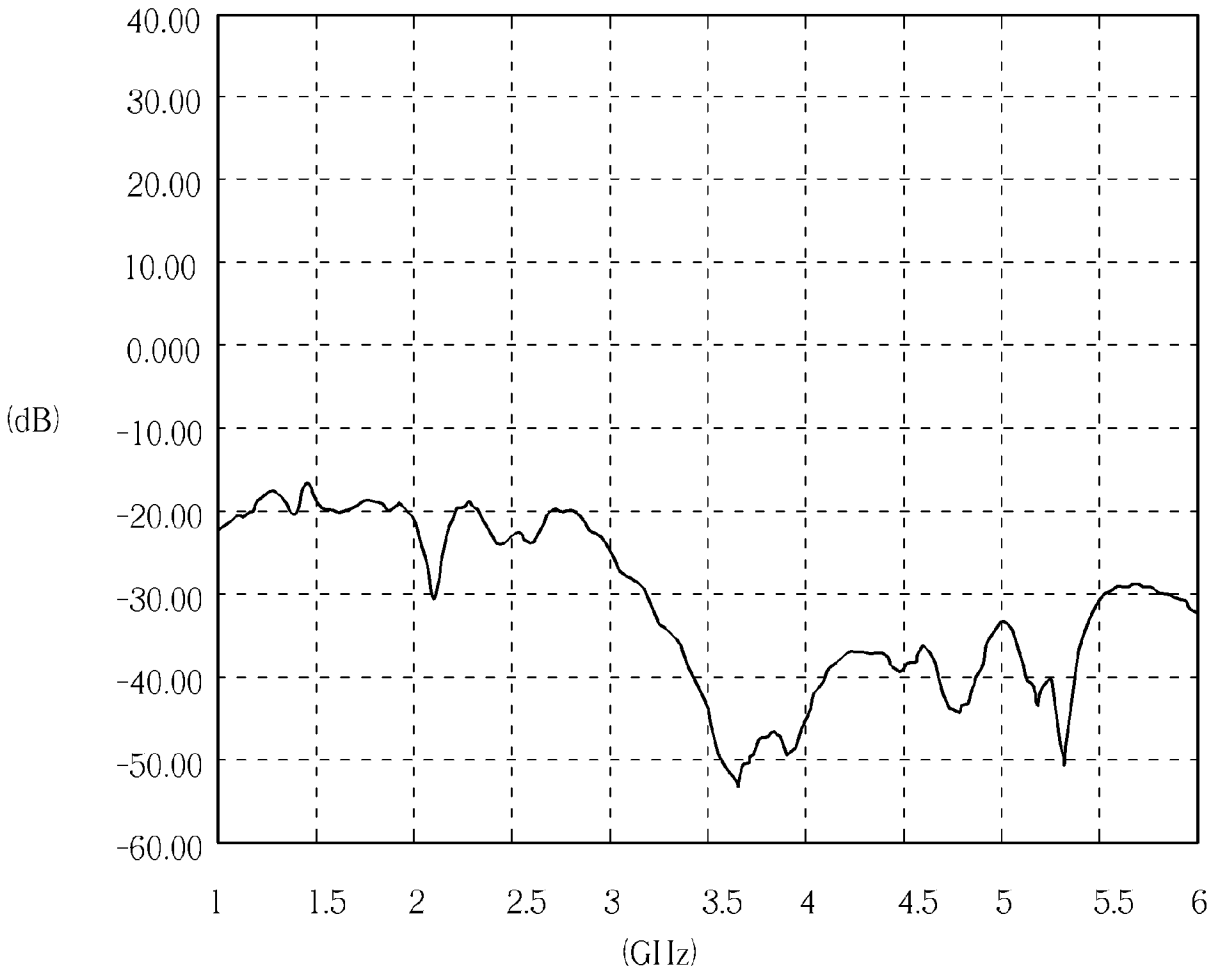
Figure 3C:
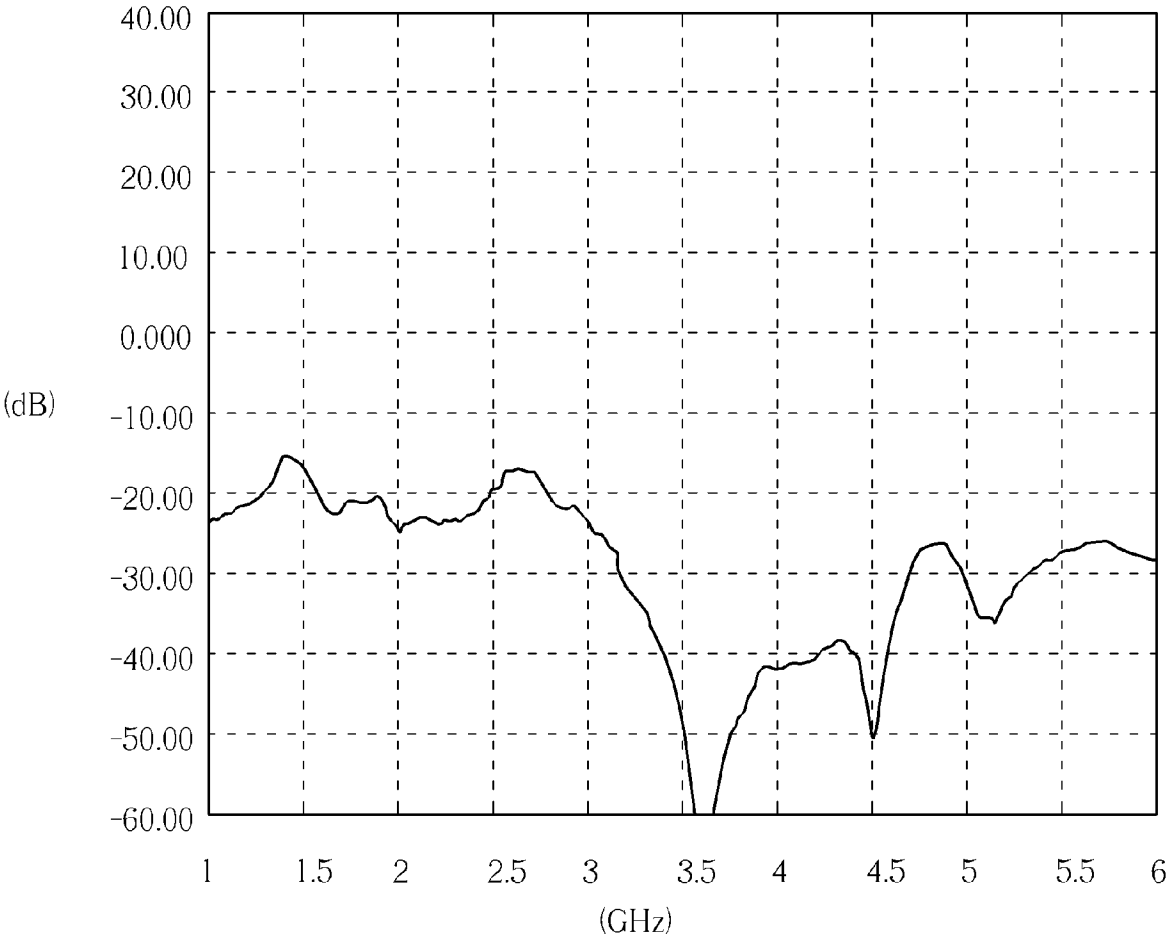

If the sizes, material, etc. of the radiators of the multi-antenna 10 are adjusted properly for a dual band (around 2.4 GHz and 5.12 GHz) wireless local area network system conformed to IEEE 802.11 standard, the corresponding isolation effects can be expressed by FIGS. 3A-3C. FIG. 3A is a return loss diagram of the vertical antenna 106 to the planar antenna 102, and the drawing method is to set the vertical antenna 106 as a signal output terminal and the planar antenna 102 as a signal input terminal for measuring or simulating a power ratio from the planar antenna 102 transmitting or coupling to the vertical antenna 106. Therefore, as can be seen in FIG. 3A, around 2.4 GHz, power of the planar antenna 102 coupling to the vertical antenna 106 is smaller than −19 dB, which indicates isolation between the vertical antenna 106 and the planar antenna 102 in this frequency range, is larger than 19 dB, and around 5 GHz, isolation is larger than 28 dB. Similarly, FIG. 3B is a return loss diagram of the planar antenna 104 to the planar antenna 102, which shows a power ratio from the planar antenna 102 coupling to the planar antenna 104. As can be seen, around 2.4 GHz, isolation between the planar antenna 104 and the planar antenna 102 is larger than 23 dB, and around 5 GHz, isolation is larger than 30 dB. Finally, FIG. 3C is a return loss diagram of the vertical antenna 106 to the planar antenna 104, which shows a power ratio from the planar antenna 104 coupling to the vertical antenna 106. As can be seen, around 2.4 GHz, isolation between the vertical antenna 106 and the planar antenna 104 is larger than 20 dB, and around 5 GHz, isolation is larger than 27 dB.

Briefly summarize the results of FIGS. 3A-3C, isolation among the planar antennas 102 and 104, and the vertical antenna 106 is larger than 20 dB around 2.4 GHz, and is larger than 27 dB around 5 GHz. With such isolation effect, interference between the antennas can be effectively avoided, and efficiency of the multi-antenna 10 can be increased also.

The abovementioned description only illustrates relevant parts of the spirit of the present invention. Since other possible changes, additional components, and so on do not affect scope of the present invention, detailed description is not given here. However, those skilled in the art can still make alternations and modifications according to system requirements. For example, shielding metals can be added to sides of the conductors TML_1 and TML_2, to enhance transmission effect. In addition, in FIG. 1, the substrate 100 is preferably a multi-layer printed circuit board, on which the conductors TML_1, TML_2, and TML_3 and the radiators RDT_1 and RDT_2 are printed and one layer of the multi-layer printed circuit board is a common ground layer.

In conclusion, the present invention includes two monopole planar antennas in two orthogonal directions of the common plane, and a dipole vertical antenna between the two monopole planar antennas, to generate three orthogonal time-varying current directions and linear polarized fields, and realize three-dimensional polarization diversity. Meanwhile, the vertical antenna is placed between the two planar antennas having common ground, to enhance isolation and improve antenna efficiency.

Those skilled in the art will readily observe that numerous modifications and alterations of the device and method may be made while retaining the teachings of the invention.

What is claimed is:

1. A multi-antenna for a multi-input multi-output wireless communication system comprising:

a substrate;

a first planar monopole antenna of a first current direction formed on a surface of the substrate along a first direction;

a second planar monopole antenna of a second current direction formed on the surface of the substrate along a second direction; and a vertical dipole antenna of a third current direction, comprising:

a conductor formed on the surface of the substrate and between the first planar monopole antenna and the second planar monopole antenna; and a radiator perpendicular to the substrate and coupled to the conductor;

wherein the first, second, and third current directions are orthogonal to each other.

2. The multi-antenna of claim 1, wherein the first direction and the second direction are orthogonal.

3. The multi-antenna of claim 2, wherein radiating fields generated respectively by the first planar monopole antenna and the second planar monopole antenna are in 90 degrees of polarization diversity.

4. The multi-antenna of claim 1, wherein the first planar monopole antenna comprises:

a first conductor formed on the substrate along the first direction; and a first radiator formed on the substrate and coupled to the first conductor.

5. The multi-antenna of claim 4, wherein the first radiator comprises two branches, and the first planar monopole antenna is a dual-band antenna.

6. The multi-antenna of claim 4, wherein the first planar monopole antenna further comprises a signal feeding terminal formed at an end of the first conductor uncoupled to the first radiator.

7. The multi-antenna of claim 1, wherein the second monopole planar antenna comprises:

a second conductor formed on the substrate along the second direction; and a second radiator formed on the substrate and coupled to the second conductor.

8. The multi-antenna of claim 7, wherein the second radiator comprises two branches, and the second planar monopole antenna is a dual-band antenna.

9. The multi-antenna of claim 7, wherein the second planar monopole antenna further comprises a signal feeding terminal formed at an end of the second conductor uncoupled to the second radiator.

10. The multi-antenna of claim 1, wherein the radiator of the vertical dipole antenna comprises:

an upper radiator formed on the substrate and coupled to the conductor; and a lower radiator formed under the substrate and coupled to the conductor.

11. The multi-antenna of claim 10, wherein shapes of the upper radiator and the lower radiator are symmetric.

12. The multi-antenna of claim 11, wherein both of the upper radiator and the lower radiator comprise two branches, and the vertical dipole antenna is a dual-band antenna.

13. The multi-antenna of claim 1, wherein the vertical dipole antenna further comprises a vertical substrate for disposing the radiator.

14. The multi-antenna of claim 1, wherein the vertical dipole antenna further comprises a signal feeding terminal formed at an end of the conductor uncoupled to the radiator.

15. A multi-antenna for a multi-input multi-output wireless communication system comprising:

a substrate;

a first planar monopole antenna of a first polarization direction formed on a surface of the substrate along a first direction;

a second planar monopole antenna of a second polarization direction formed on the surface of the substrate along a second direction; and a vertical dipole antenna of a third polarization direction, comprising:

a conductor formed on the surface of the substrate and between the first planar monopole antenna and the second planar monopole antenna; and a radiator perpendicular to the substrate and coupled to the conductor;

wherein the first polarization direction is orthogonal to the third polarization direction, and the second polarization direction is orthogonal to the third polarization direction.

16. The multi-antenna of claim 15, wherein the first planar monopole antenna is orthogonal to the second planar monopole antenna.

17. The multi-antenna of claim 15, wherein radiating fields generated respectively by the first planar monopole antenna and the second planar monopole antenna are in 90 degrees of polarization diversity.

18. The multi-antenna of claim 15, wherein the first planar monopole antenna comprises:

a first conductor formed on the substrate along the first direction; and a first radiator formed on the substrate and coupled to the first conductor.

19. The multi-antenna of claim 15, wherein the radiator of the vertical dipole antenna comprises:

an upper radiator formed on the substrate and coupled to the conductor; and a lower radiator formed under the substrate and coupled to the conductor.

20. The multi-antenna of claim 15, wherein the vertical dipole antenna further comprises a signal feeding terminal formed at an end of the conductor uncoupled to the radiator.

* * * * *